US005222279A

United States Patent [19]

Frano et al.

[11] Patent Number: 5,222,279

[45] Date of Patent: Jun. 29, 1993

[54] BUCKLE HAVING INCREASED HOLDING POWER WHEN UNDER LOAD

[75] Inventors: Francis G. Frano, Hoffman Estates; Steven C. Keller, Island Lake, both of Ill.

[73] Assignee: Illinois Tool Works Inc., Glenview, Ill.

[21] Appl. No.: 919,964

[22] Filed: Jul. 27, 1992

[51] Int. Cl.[5] ..... A44B 11/25

[52] U.S. Cl. ..... 24/625

[58] Field of Search ..... 24/614, 615, 616, 625

[56] References Cited

U.S. PATENT DOCUMENTS

| | | | |
|---|---|---|---|
| 874,957 | 12/1907 | Godley | 24/615 |
| 4,662,040 | 5/1987 | Terrell et al. | 24/615 X |
| 4,672,725 | 6/1987 | Kasai | 24/625 |
| 4,831,694 | 5/1989 | Kong | 24/615 X |
| 5,131,122 | 7/1992 | Lavato | 24/616 X |

*Primary Examiner*—James R. Brittain

*Attorney, Agent, or Firm*—Schwartz & Weinrieb

[57] ABSTRACT

A buckle including a female receptacle member having a tubular body, an interior channel therethrough and being open to the channel on a portion of the tubular body, a male latch member having at least one arm member for insertion within the channel through the open end of the female receptacle member and a latch member formed between the tubular body and the arm member for releasable locking engagement of the tubular body and the arm member upon insertion of the arm member within the channel and for providing a resistance force in opposition to and alignment with an arm member removal loading force between the tubular body and the arm member.

14 Claims, 1 Drawing Sheet

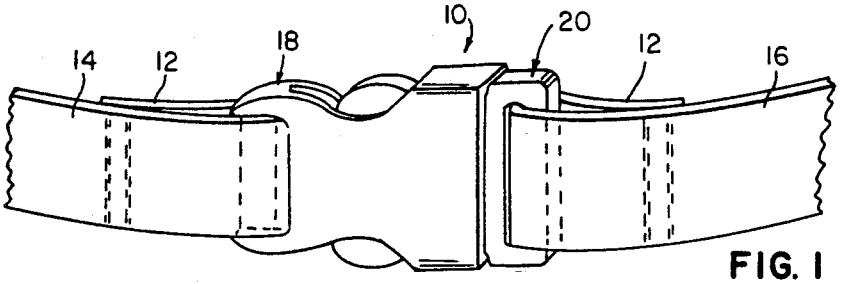
FIG. 1
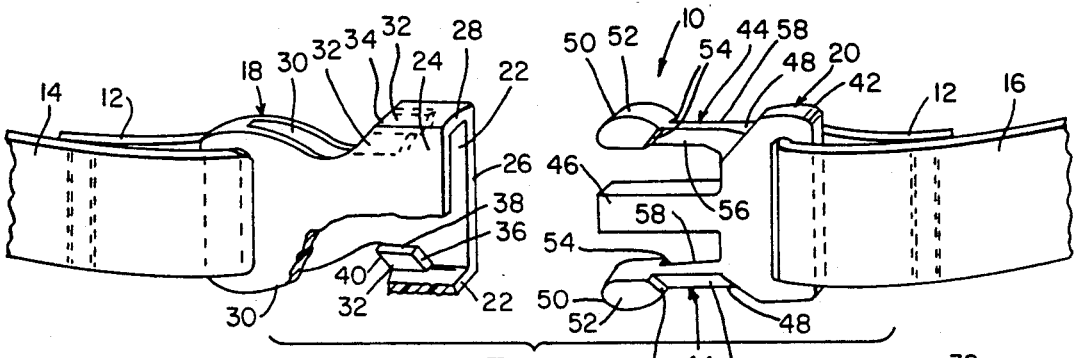
FIG. 2
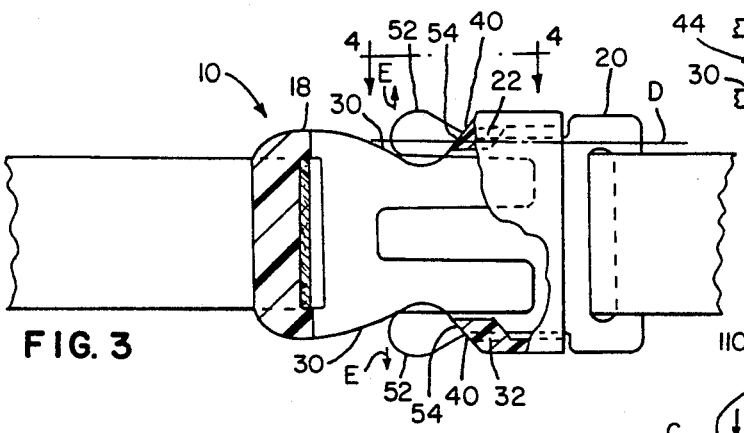
FIG. 3
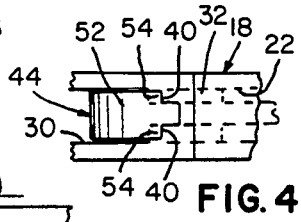
FIG. 4
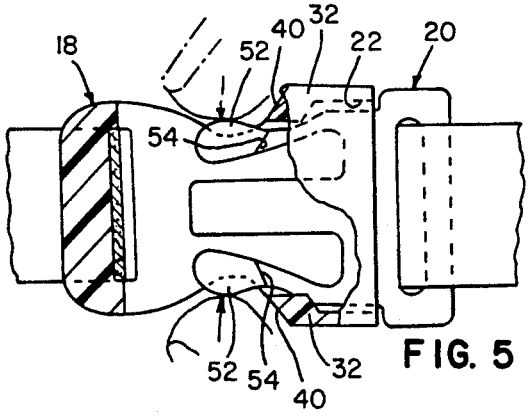
FIG. 5
FIG. 7
PRIOR ART
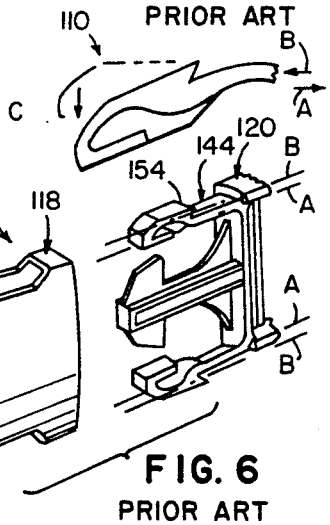
FIG. 6
PRIOR ART

BUCKLE HAVING INCREASED HOLDING POWER WHEN UNDER LOAD

BACKGROUND OF THE INVENTION

1. Field of the Invention

This invention relates generally to buckles, and more particularly to a releasable buckle having a female receptacle member and a corresponding male latch member which provides a latch resistance force in opposition to and alignment with a loading force acting to remove the male latch member to thereby increase the holding strength of the buckle.

2. Description of the Related Art

Buckles typically include male and female connector members, one each connected to a free end of a strap, web belt or the like, to provide a connection between the two free ends of the straps. In order to connect the male and female members, the male member includes an engagement arm which is inserted within and releasably connected to the female connector member and can be engaged by a user to later disconnect the male and female connector members.

An example of such a buckle is disclosed in U.S. Pat. No. 4,150,464 which substantially is illustrated in FIGS. 6 and 7 and is assigned to the same assignee as the assignee herein. As FIGS. 6 and 7 illustrate, the female connector member includes apertures formed in opposite side walls for engagement with shoulders of corresponding latch arms formed with the male connector member. Since the shoulders, however, are positioned on the outside surfaces of the latch arms and engage the side walls of the female connector member, the buckle is susceptible to failure during loading. Specifically, the typical load in the latch arms which acts to remove the latch arms from the female connector member substantially is directed along the longitudinal axis or center line "A" of each latch arm. The line "A" is slightly offset from the line "B" which is the line upon which the latch resistance or engagement force substantially is directed between the side walls of the female connector member and the shoulders on the outside surfaces of the latch arms. Accordingly, as FIG. 7 illustrates, during loading a torque develops between the latch arms and the female connector member which tends to cause inward rotation of the latch arms in the direction of arrow "C" which causes failure of the latch arms and/or release of the buckle.

It therefore would be desirable to provide a buckle having male and female connector members where the male member is releasably retained within the female member and provides increased holding by aligning the resistance and loading forces between the male and female members.

SUMMARY OF THE INVENTION

The invention provides a buckle including a female receptacle member having a tubular body, an interior channel therethrough and being open to the channel on a portion of the tubular body. A male latch member is included having at least one arm member for insertion within the channel through the open end of the female receptacle member. A latching member is provided between the tubular body and the arm member for releasable locking engagement of the tubular body and the arm member upon insertion of the arm member within the channel and for providing a resistance force in opposition to and alignment with an arm member removal loading force between the tubular body and the arm member.

BRIEF DESCRIPTION OF THE DRAWINGS

Various other objects, features, and attendant advantages of the present invention will be more fully appreciated from the following detailed description, when considered in connection with the accompanying drawings, in which like reference characters designate like or corresponding parts throughout the several views, and wherein:

FIG. 1 is a perspective view of the buckle of the invention illustrated in a coupled condition and in conjunction with a pair of free ends of a belt or the like;

FIG. 2 is a perspective view, similar to FIG. 1, illustrating the buckle in its opened or uncoupled condition and with a portion of the female connector member broken away and another portion in dotted outline illustrating the interior engagement members thereof;

FIG. 3 is a top plan view of the buckle of the invention its coupled condition with a portion or the female connector member broken away illustrating the connection between the male and female connector members;

FIG. 4 is a side elevational view of the buckle of the invention taken along line 4—4 of FIG. 3 and in the direction indicated generally illustrating the engagement between the male and female connector members in detail;

FIG. 5 is a top plan view of the buckle of the invention, similar to FIG. 3, illustrating release of the male and female connector members;

FIG. 6 is a perspective exploded view of a prior art side release buckle member; and FIG. 7 is an enlarged view of a portion of the prior art buckle of FIG. 6 illustrating the engagement and failure positions between the male and female connector members.

DESCRIPTION OF THE PREFERRED EMBODIMENTS

Referring to FIGS. 1 and 2, a buckle of the invention is designated generally by the reference numeral 10. The buckle 10 typically is utilized to connect free ends 12 of webs or straps 14 and 16 and includes a female receptacle member 18 and a complementary male latch member 20.

The buckle 10 preferably is formed from plastic, but the particular material can vary. Additionally, the straps 14 and 16 preferably are connected by threading the free ends 12 through a portion of the female and male members 18 and 20, respectively, and then sewing the free ends 12 back onto the respective strap 14 and 16. Alternatively, the straps 14 and 16 can be connected in an adjustable manner (not illustrated.)

As FIG. 2 illustrates, the female receptacle member 18 preferably has a flat rectangular tubular cross-sectional configuration having a substantially rectangular shaped interior channel 22 defined by a first top surface or wall 24, a second opposite bottom surface or wall 26 and third and fourth opposite side walls 28. In order to provide the flat or rectangular shape to the female receptacle member 18, the top and bottom surfaces 24 and 26 are wider than the side walls 28.

As will be explained in detail below, the male latch member 20 is received and releasably retained within the channel 22 of the female receptacle member 18. To enable access and release of the male latch member 20 from the exterior of the female receptacle member 18 by a user and assist in retaining the male latch member 20 within the female receptacle member 18, the female receptacle member 18 includes two apertures 30. Each aperture 30 extends at least through a portion of the top or bottom surfaces 24 and 26, and preferably extends through both the top and bottom surfaces 24 and 26 as well as through the opposite side walls 28 to form a side-release type buckle 10. It is to be understood, however, that the shape, location, position and number of apertures 30 can vary so long as the buckle 10 operates as described herein.

To guide the male latch member 20 as it is inserted into the channel 22 and retain the male latch member 20 therein, two pairs of engagement members 32 are positioned within the channel 22, one pair each on opposite sides of the channel 22. The engagement members 32 in each pair are formed with one engagement member 32 spanning the intersection of the side wall 28 and the top surface 24 and the other engagement member 32 spanning the intersection of the side wall 28 and the bottom surface 26. A gap 34 is provided between the engagement members 32 of each pair for accepting a portion of the male latch member 20 therebetween.

To guide and retain the male latch member 20, each engagement member 32 includes a first ramped surface 36, a second sliding surface 38 and a third locking surface 40. The third locking surface 40 of each engagement member 32 substantially is in alignment with one end of a respective aperture 30.

The male latch member 20 preferably includes a base portion 42 having two substantially flexible arm members 44 formed on opposite ends of the base portion 42 and extending outwardly away from one side of the base portion 42 a predetermined distance. If desired, to assist in insertion of the male latch member 20 within the channel 22, the male latch member 20 can include a guide arm 46 formed between the arm members 44 for complementary engagement with an alignment groove (not illustrated) formed within the channel 22 of the female receptacle member 18.

Each arm member 44 includes a first proximal end 48 connected to the base portion 42 and a second opposite distal end 50. To assist in sliding cooperation with the engagement members 32 and enable access to a user, the distal end 50 of each arm member 44 can include a rounded protrusion 52 on its outside surface. To releasably engage the arm members 44 within the female receptacle member 18, each arm member 44 preferably includes a shoulder 54 formed on both a top surface 56 and a bottom surface 58 of the arm members 44.

Preferably, to assist in engagement and prevent premature releasing of the male latch member 20 under load, the shoulders 54 are formed at an angle for cooperation with a complementary angle of the third locking surfaces 40 of the engagement members 32 as will be described in detail below.

To releasably connect the male latch member 20 to the female receptacle member 18, the second distal end 50 of each arm member 44 first is inserted within the channel 22. Upon continued insertion, the distal ends 50 will contact the first ramped surface 36 of each engagement member 32 and each arm member 44 will be flexed toward the interior of the channel 22. Further insertion provides for the protrusions 52 to ride along the second sliding surface 38 of each engagement member 32 until the protrusions 52 and the shoulder 54 clear the second sliding surface 38. At that point, each arm member 44 snaps outward with respect to the channel 22 and, as FIGS. 3 and 4 illustrate, the shoulders 54 are seated against the third locking surface 40 of each engagement member 32 and the protrusions 52 extend outward through the apertures 30.

As FIG. 5 illustrates, to release the male latch member 20 from the channel 22, a user engages the protrusions 52 and exerts an inward pressure thereon to flex the arms 44 inward with respect to the channel 22. Once the shoulders 54 of the arm members 44 clear the locking surface 40 of the engagement members 32 the male latch member 20 can be removed from the channel 22.

As described earlier, the prior art buckle 110 illustrated in FIGS. 6 and 7 includes shoulders 154 located on the outside edges of the arm members 144 of the male latch member 120. Accordingly, the force provided under load is centered along line "A", which runs through the longitudinal center line or axis of each arm member 144, while the engagement or retaining force provided by the shoulders 154 is centered along line "B", which runs through the shoulders 154 and is slightly offset from the line "A". The offset between lines "A" and "B" produces a torque on the arm members 154 substantially in the direction of arrow "C" in FIG. 7 causing premature breakage of the arm members 144 and/or release of the buckle 110.

In contrast, as FIG. 3 illustrates, the buckle 10 of the present invention provides alignment along line "D" of both the load force through the longitudinal center line or axis of each arm member 44 and the engagement or retaining force provided by the shoulders 54. This alignment of forces is possible due to the positioning of the shoulders 54 along the top and bottom surfaces 56 and 58 of the arm members 44 and the cooperation with the third locking surfaces 40 of the engagement members 32.

Additionally, when a load separating force is applied to the buckle 10, the cooperation between the shoulders 54 and the third locking surfaces 40 actually cause the arm members 44 to be biased outwardly by virtue of the sliding relationship between the surfaces. More specifically, when a load separating force is applied to the buckle 10 along line "D" an outward force is provided in the direction of arrow "E" in FIG. 3 caused by the shoulders 54 moving slightly down the complementary third locking surfaces 40. The existence of this slight outward force provides increased holding power of the buckle 10 and prevents premature release.

Modifications and variations of the present invention are possible in light of the above teachings. It is therefore to be understood that within the scope of the appended claims, the invention may be practiced otherwise than as specifically described.

What is claimed and desired to be secured by Letters Patent of the Unites States is:

1. A buckle, comprising:

a female receptacle member comprising a tubular body, an interior channel extending therethrough and open at one end thereof, and engagement means defined within said tubular body;

a male latch member having at least one arm member for insertion within said interior channel of said tubular body through said open end of said interior channel of said tubular body of said female receptacle member, said at least one arm member having a predetermined lateral width extending from a laterally outward position to a laterally inward position with respect to said interior channel of said tubular body, and a longitudinal axis extending longitudinally through said at least one arm member; and latch means disposed upon said at least one arm member for releasable locking engagement with said engagement means of said tubular body upon insertion of said at least one arm member within said interior channel of said tubular body, said latch means of said at least one arm member having a predetermined width, extending from a laterally outward position to a laterally inward position with respect to said interior channel of said tubular body, and a disposition upon said at least one arm member such that a longitudinal axis of said latch means coincides with said longitudinal axis of said at least one arm, as considered in said width direction, so as to provide a retaining force, acting along said longitudinal axis of said latch means, in opposition to and alignment with an arm member removal load force, as considered in said width direction, acting along said longitudinal axis of said at least one arm member.

2. The buckle as defined in claim 1 wherein said engagement means include an engagement member formed within said channel and said lately means comprises a shoulder formed proximate a distal end of said arm member, said engagement means providing inward deflection of said arm member with respect to said channel by said engagement member upon insertion of said arm member within said channel until said arm member clears said engagement member and flexes in a first direction toward the exterior of said channel to obtain a locked position, said shoulder being formed on a surface of said arm member, said surface facing a second direction substantially perpendicular to said first direction to provide said alignment of forces.

3. The buckle as defined in claim 2 including an aperture through said tubular body proximate said engagement member to provide access to said arm member from the exterior of said tubular body for release of said arm member from said engagement member.

4. The buckle as defined in claim 2, wherein:

said engagement member and said latch shoulder are formed at cooperating complementary angles so as to provide increased holding power and prevent premature release of said buckle under load.

5. A buckle as set forth in claim 2, wherein:

said engagement member of said engagement means including a ramped surface for providing said inward deflection of said at least one arm member upon insertion of said at least one arm member within said interior channel of said tubular body.

6. A buckle as set forth in claim 1, wherein:

said at least one arm member comprises a pair of laterally spaced arm members.

7. A buckle as set forth in claim 1, further comprising:

means defined upon both of said female receptacle and male latch members for securing ends of webs thereto whereby said ends of said webs are able to be connected together by said buckle.

8. A buckle, comprising:

a female receptacle member comprising a substantially flat tubular body, having an interior channel extending therethrough, formed by two opposed top and bottom walls and two opposed side walls, said top and bottom walls being wider than said side walls, said tubular body having a predetermined length and being open to said channel on at least one end thereof;

a male latch member having at least one longitudinally extending and substantially flexible arm member for insertion into said interior channel of said female receptacle member through said open end of said female receptacle member, said at least one arm member having a predetermined lateral width extending from a laterally outward position to a laterally inward position with respect to said interior channel of said tubular body and in a direction extending between said side walls of said tubular body;

engagement means defined within said tubular body; and latch means disposed upon said at least one arm member for releasable locking engagement with said engagement means of said tubular body, said latch means being accessible form the exterior of said tubular body for releasable engagement from said engagement means of said tubular body by a user, and said latch means comprising latch surfaces disposed upon opposite sides of said at least one arm member so as to extend toward both said top and bottom walls of said tubular body, said latch surfaces also having predetermined lateral width dimensions which correspond to said predetermined lateral width of said at least one arm member.

9. The buckle as defined in claim 8 wherein said engagement means include an engagement member formed with both of said top and bottom walls and said latch means of said arm member includes a pair of engagement shoulders, one each formed on opposite sides of said arm member for cooperative engagement with said engagement members of said top and bottom surfaces.

10. The buckle as defined in claim 9 including an aperture formed through said tubular body proximate at least one of said engagement members to provide access to said arm member from the exterior of said tubular body for release of said arm member from said engagement members.

11. The buckle as defined in claim 9 wherein said engagement members and said engagement shoulders are formed at cooperating complementary angles to provide increased holding power and prevent premature release of the buckle when under load.

12. A buckle as set forth in claim 8, wherein:

said at least one arm member comprises a pair of laterally spaced arm members.

13. A buckle as set forth in claim 12, further comprising:

aperture means defined within both of said opposed side walls of said tubular body for providing access to said pair of laterally spaced arm members from the exterior of said tubular body so as to permit said pair of laterally spaced arm members to be released from said engagement means of said tubular body.

14. A buckle as set forth in claim 8, further comprising:

means defined upon both of said female receptacle and male latch members for securing ends of webs thereto whereby said ends of said webs are able to be connected together by said buckle.

* * * * *